US010047485B2

(12) United States Patent
Fu et al.

(10) Patent No.: US 10,047,485 B2
(45) Date of Patent: Aug. 14, 2018

(54) ASSEMBLED TYPE PIER COLUMN MEMBER WITH STEEL-CONCRETE COMPOSITE STRUCTURE

(71) Applicant: Hohai University, Nanjing, Jiangsu (CN)

(72) Inventors: Zhongqiu Fu, Jiangsu (CN); Bohai Ji, Jiangsu (CN); Zhenpeng Yu, Jiangsu (CN)

(73) Assignee: Honhai University, Nanjing, Jiangsu (CN)

( * ) Notice: Subject to any disclaimer, the term of this patent is extended or adjusted under 35 U.S.C. 154(b) by 0 days.

(21) Appl. No.: 15/523,955

(22) PCT Filed: Sep. 25, 2015

(86) PCT No.: PCT/CN2015/090689
§ 371 (c)(1),
(2) Date: May 3, 2017

(87) PCT Pub. No.: WO2017/045223
PCT Pub. Date: Mar. 23, 2017

(65) Prior Publication Data

US 2017/0356144 A1 Dec. 14, 2017

(30) Foreign Application Priority Data

Sep. 18, 2015 (CN) ..... 2015 1 0601078

(51) Int. Cl.
*E01D 19/02* (2006.01)
*E01D 21/00* (2006.01)
*E01D 101/26* (2006.01)

(52) U.S. Cl.
CPC ..... *E01D 19/02* (2013.01); *E01D 21/00* (2013.01); *E01D 2101/268* (2013.01)

(58) Field of Classification Search
CPC ..... E01D 19/02; E01D 19/005; E01D 19/14; E01D 21/00; E01D 2101/28;
(Continued)

(56) References Cited

U.S. PATENT DOCUMENTS 1,584,203 A * 5/1926 Upson ..... E02D 19/04 405/222
3,487,646 A * 1/1970 Gatien ..... E02D 5/30 405/249

(Continued)

FOREIGN PATENT DOCUMENTS

CN 101831875 9/2010
CN 104294753 1/2015

(Continued)

OTHER PUBLICATIONS

International Search Report and Written Opinion of PCT/CN2015/090689 dated Jun. 22, 2016, 12 pages (English and Chinese).

*Primary Examiner* — Abigail A Risic
(74) *Attorney, Agent, or Firm* — Rankin, Hill & Clark LLP

(57) ABSTRACT

A segment-assembled type pier column member with a steel-concrete composite structure includes a reinforcement tube embedded in a pile cap, wherein the reinforcement tube is connected with a bottom of a lower segment of a hollow steel tube pier and is poured with concrete, and pier columns in upper and lower segments are reinforced by means of segment connecting and being embedded with local reinforcing meshes. A steel cross beam is connected with an upper segment of the hollow steel tube pier in an assembled way. A pre-stressed tensioning duct is reserved between the steel cross beam and the pier column in the upper segment.

8 Claims, 3 Drawing Sheets

(58) Field of Classification Search
CPC ..... E01D 2101/268; E01D 2101/285; E01D 2101/30; E01D 2101/32; E02D 5/22
See application file for complete search history.

(56) References Cited

U.S. PATENT DOCUMENTS

| | | | | | |
|---|---|---|---|---|---|
| 3,890,794 | A * | 6/1975 | Broadfoot | E02D 5/14 | 405/216 |
| 4,767,240 | A * | 8/1988 | Ohkawara | E02B 3/06 | 405/195.1 |
| 5,870,789 | A * | 2/1999 | Carranza-Aubry | E01D 2/02 | 14/73 |
| 9,873,995 | B1 * | 1/2018 | Chen | E01D 19/02 | |
| 2003/0182883 | A1 * | 10/2003 | Won | E01D 2/02 | 52/223.8 |
| 2004/0055234 | A1 * | 3/2004 | Mutsuyoshi | E01D 19/02 | 52/292 |
| 2008/0196341 | A1 * | 8/2008 | Kang | E01D 19/02 | 52/292 |
| 2017/0233961 | A1 * | 8/2017 | Tokuno | E01D 19/125 | 14/73 |
| 2017/0247844 | A1 * | 8/2017 | Saiidi | E01D 22/00 | |

FOREIGN PATENT DOCUMENTS

| | | | | |
|---|---|---|---|---|
| CN | 104404869 | | 3/2015 | |
| CN | 104746422 | | 7/2015 | |
| JP | 08232209 | A * | 9/1996 | |
| JP | 2006104747 | A * | 4/2006 | E01D 19/02 |
| JP | 2009161905 | | 7/2009 | |
| KR | 20140027701 | | 3/2014 | |
| KR | 101406035 | | 6/2014 | |

* cited by examiner

ASSEMBLED TYPE PIER COLUMN MEMBER WITH STEEL-CONCRETE COMPOSITE STRUCTURE

TECHNICAL FIELD

The present invention relates to an engineering structural pier column component, and more particularly, to a pier column member with a composite structure in an assembled construction method. The member is convenient to prefabricate, process and install, so that the construction progress is effectively accelerated; moreover, the member has a good engineering application prospect, and belongs to the field of structure engineering technology.

BACKGROUND

A pier mainly consists of a hood and a pier body. The hood plays a role of dispersedly and uniformly transmitting a higher but concentrated force from a bridge span support to the pier body and a pile cap body. Therefore, the hood shall be made by a material with higher strength. In addition, the hood shall also have a larger plan view size to provide a necessary working surface for construction, girder erection and maintenance. Both the pier body and the pile cap body are major structures for supporting the bridge span, which not only bear all the loads coming from the bridge span structure, but also directly bear earth pressure, water impact force, ice pressure, ship impact force and other various loads. Therefore, both the pier body and the pile cap body have sufficient strength, rigidity and stability, and are important parts of a bridge structure.

Commonly used piers include two types, wherein one is a gravity type pier, and the other is a light type pier. The gravity type pier is generally a concrete or stone-built solid structure. An upper portion of the pier body is provided with a pier cap and a lower portion thereof is connected with a foundation. The gravity type pier is characterized by fully utilizing anti-pressure properties of masonry materials, bearing outer forces from a vertical direction and a horizontal direction by larger cross-section size and weight thereof. The gravity type pier has the advantages of firm and durable performance, easiness in construction, convenience in obtaining materials, steel-saving, or the like. The disadvantages of the gravity type pier are as follows: the amount of masonry is large and the appearance thereof is bulky and heavy, so that an effective aperture under the bridge is reduced, and the foundation load is increased; and it is particularly unfavorable when the pier is higher and the foundation bearing capacity is lower. However, the light type pier has the advantages of light and beautiful appearance and less amount of masonry, can lighten the foundation load, saves foundation works, is convenient to construct by an assembled structure or a climbing form, is beneficial for accelerating the construction progress, and enhances the labor productivity, or the like. The disadvantage of the light type pier is that the structure of the pier in some cases is more complex, so that a certain degree of difficulty is present in construction, and a certain degree of difficulty is also present in construction schedule and control.

It is obvious that to design a novel assembled type pier column structure has become a technical problem to be solved urgently.

BRIEF DESCRIPTION

Object of the invention: in order to overcome the defects of the prior art, the present invention provides an assembled type pier column member with a steel-concrete composite structure, which takes the construction cost and progress into consideration, reduces the volume of the member, accelerates the construction progress and improves the safety while ensuring that the structure of the pier is stressed reasonably and safely, and meets the reasonable design requirement.

Technical solutions: in order to solve the above technical problems, an assembled type pier column member with a steel-concrete composite structure provided by the present invention includes a pile cap, a pier column and a cross beam, wherein a reinforcement tube is pre-embedded in the pile cap, the pier column is in a hollow tubular structure and is formed by connecting an upper segment of a pier and a lower segment of the pier in an assembled way, a bottom end of the lower segment of the pier is installed between the reinforcement tube and concrete, the upper segment of the pier is connected with the cross beam in an assembled way via bracket angle steel; and the cross beam is in a pre-stressed structure.

Preferably, a bottom of the reinforcement tube is welded with a bottom plate, a stiffening ribbed plate is welded between the bottom plate and a reinforcing plate, and the bottom plate and the stiffening ribbed plate are embedded in the concrete of the pile cap.

Preferably, a top end of the upper segment of the pier is provided with a T-shaped opening hoop, and a bottom end thereof is provided with a flange plate.

Preferably, a top end of the lower segment of the pier is provided with a flange plate, a bottom end thereof is provided with radially-distributed stiffening ribbed plates, and the stiffening ribbed plates are embedded in the concrete.

Preferably, reinforcing meshes are connected between the upper segment of the pier and the lower segment of the pier, and a reinforcing mesh clamping sheet is arranged inside an upper end of the lower segment of the pier.

Preferably, the cross beam is a steel cross beam with an I-shaped cross section.

Preferably, concrete is poured into the pier column and the cross beam, and the cross beam is further internally penetrated with a pre-stressed steel strand in a post-tensioning method.

The present invention also proposes a construction method of the assembled type pier column member with a steel-concrete composite structure at the same time, including the following steps of:

step 1, prefabricating a pile cap, a pier column and a cross beam; arranging a stiffening ribbed plate at a lower end of a lower segment of a pier, arranging a reinforcing mesh clamping sheet inside a tube wall at the upper end, and arranging a pier connecting ring outside the tube wall; arranging a pier connecting ring outside an lower end of an upper segment of the pier, and arranging a T-shaped opening hoop for lapping I-steel stretched out from a steel cross beam at an upper end thereof;

step 2, embedding a pile cap cross section reinforcement tube in the pile cap for ensuring the installation and positioning of the lower segment of the pier and reinforcing stress applied to the segment, then pouring the pile cap;

step 3, sheathing the lower segment of the pier on the pile cap cross section reinforcement tube, and pouring concrete to fixedly connect the lower segment of the pier with the pile cap;

step 4, connecting pier columns in upper and lower segments through a flange plate, and arranging reinforcing meshes inside the cross section for reinforcing connection;

step 5, connecting a hollow steel tube pier column with the steel cross beam, lapping I-steel stretched out from two ends of the steel cross beam in the T-shaped opening hoop arranged at the upper end, and connecting the two in an assembled way through a bolt using bracket angle steel in the meanwhile;

step 6, tensioning a pre-stressed steel strand in a transverse direction of the two ends of the steel cross beam using a post-tensioning method; and step 7, pouring concrete into the steel tube and the cross beam from the steel cross beam. stiffening ribbed plate When in use, the section-assembled type pier column member with a steel-concrete composite structure according to the present invention includes the hollow steel tube embedded in the pile cap, and the pile cap is pre-embedded with the reinforcement tube for pouring through special treatment. The pile cap treated is connected with the bottom of the lower segment of the hollow steel tube pier in a concrete pouring method. The pier columns in upper and lower segments are reinforced and connected by means of segment connecting and being embedded with local reinforcing meshes. The steel cross beam is connected with the upper segment of the hollow steel pipe pier column in an assembled method, and the connecting method is that the steel tube concrete pier column and the steel cross beam bolt are connected in an assembled way mainly through the I-steel stretched out from the two ends of the steel cross beam and the bracket angle steel. A duct is reserved in the steel cross beam and the upper segment of the pier column, concrete is poured into the steel cross beam and the steel tube, pre-stressed steel strands at the two ends of the steel cross beam are tensioned when a certain concrete age is reached, thus forming the section-assembled type pier column member with a steel-concrete composite structure.

For the treatment of the pile cap, before pouring the pile cap, a pile cap cross section reinforcement tube is embedded in the pile cap for ensuring the installation and positioning of the lower segment of the pier and reinforcing stress applied to the segment.

When prefabricating the lower segment of the hollow pier, a stiffening ribbed plate is arranged at a lower end thereof, a reinforcing mesh clamping sheet is arranged inside an upper end of a tube thereof, and a pier connecting ring is arranged outside the lower segment.

Through a prefabricating method, a pier connecting ring is arranged outside the lower end of the upper segment of the pier, and a T-shaped opening outer tube is arranged at the upper end thereof, thus facilitating lapping the I-steel stretched out from the steel cross beam. The pier columns in upper and lower segments are connected through upper and lower pier connecting ring bolts, and reinforcing meshes are arranged inside the cross section through for reinforcing connection.

The hollow steel tube pier column is connected with the steel cross beam longitudinally, the I-steel stretched out from the two ends of the steel cross beam is lapped in the T-shaped opening outer tube at the upper end, and is connected in an assembled way through a bolt using bracket angle steel in the meanwhile. The hollow steel tube pier column is connected with the two ends of the steel cross beam transversely, tensioning the pre-stressed steel strand in a post-tensioning method. Concrete is poured into the steel tube and the cross beam from the steel cross beam after completing the above process.

Through the above method, the whole member is fabricated completely, and the working function thereof is reached in a condition of giving full play to the unique advantages.

Advantageous effects: by adopting an assembled construction method and with reference to a specific designed connecting structure, the pier column member according to the present invention has the remarkable progresses as follows:

1. The assembled type pier structure is adopted, which accelerates the construction progress and is reasonable and convenient to construct and install;

2. The steel tube concrete pier column has high anti-pressure ability, reduces the volume of the pier column, tensions the steel bar via a transverse pre-stress, can enlarge the span of the cross beam, ensures the safety of the structure, and avoids overturning.

3. The form of pouring the concrete into the steel cross beam is used, which fully exerts the tensile capacity of the steel and the anti-pressure ability of the concrete, and reduces the building height and volume of the member under a condition of meeting the design requirement; and 4. Various segments have strong connecting reliability and good assembling performance.

In addition to the above technical problems solved by the invention, the technical features forming the technical solutions and the advantages brought about by the technical features of the technical solutions, other technical problems that can be solved by the assembled type pier column member with a steel-concrete composite structure according to the invention, other technical features included in the technical solutions and the advantages brought about by these technical features will be further described in details with reference to the drawings.

In the figures: 1 refers to pile cap, 2 refers to pile cap cross section reinforcement tube, 3 refers to lower segment of pier, 4 refers to reinforcing mesh clamping sheet, 5 refers to local reinforcing mesh, 6 refers to connecting bolt, 7 refers to upper and lower pier connecting rings, 8 refers to upper segment of pier, 9 refers to pre-stressed steel, 10 refers to anchor, 11 refers to anchor base plate, 12 refers to steel cross beam, 13 refers to transverse connecting bolt, 14 refers to bracket angle steel, and 15 refers to longitudinal connecting bolt.

DETAILED DESCRIPTION

Embodiment

Figure 1:
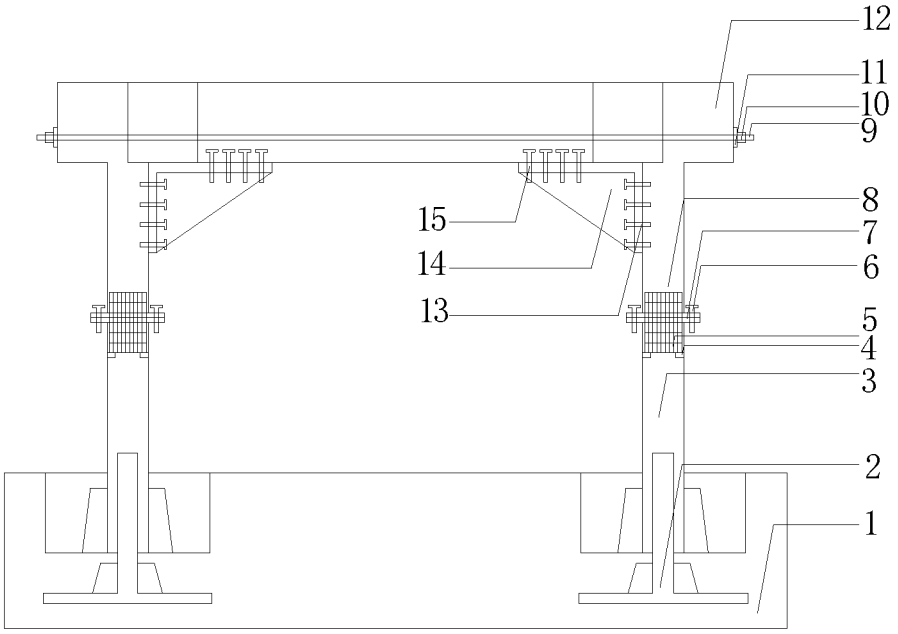
FIG. 1 is a structural schematic diagram of a section-assembled type pier column with a steel-concrete composite structure before pouring concrete in an embodiment of the present invention.
Figure 2:
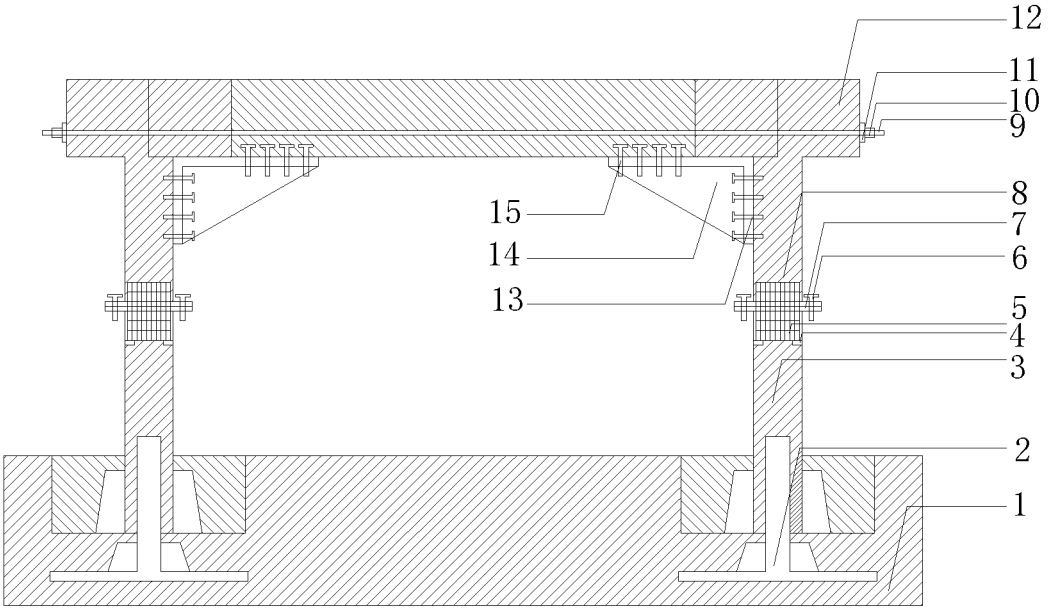
FIG. 2 is a structural schematic diagram after pouring concrete in FIG. 1.
Figure 3:
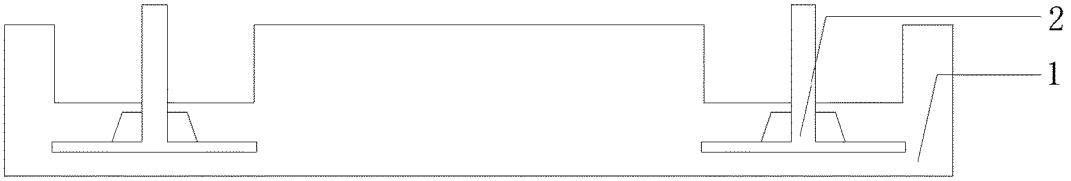
FIG. 3 is a design diagram of a cross section of a pile cap in FIG. 1.
Figure 4:
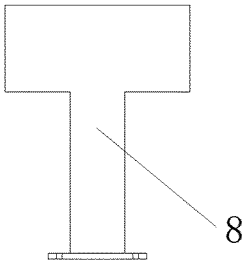
FIG. 4 is a structural schematic diagram of an upper segment of a pier in FIG. 1.
Figure 5:
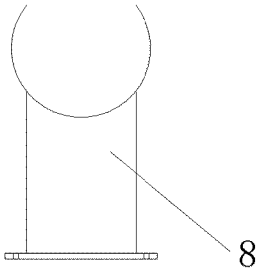
FIG. 5 is a left view of FIG. 4.
Figure 6:
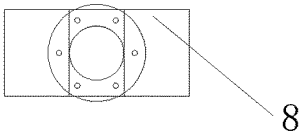
FIG. 6 is a vertical view of FIG. 4.
Figure 7:
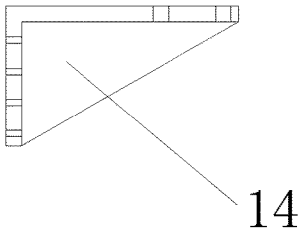
FIG. 7 is a structural schematic diagram of bracket angle steel in FIG. 1.
Figure 8:
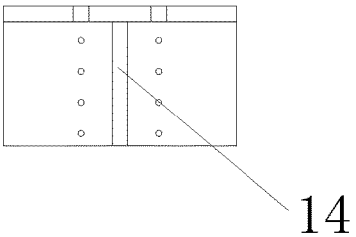
FIG. 8 is a right view of FIG. 7.
Figure 9:
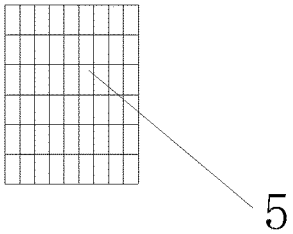
FIG. 9 is a schematic diagram of a local reinforcing mesh in FIG. 1.
Figure 10:
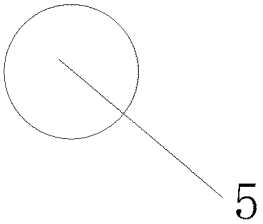
FIG. 10 is a top view of FIG. 9.
Figure 11:
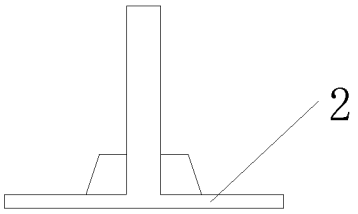
FIG. 11 is a schematic diagram of a pile cap cross section reinforcement tube in FIG. 1.
Figure 12:
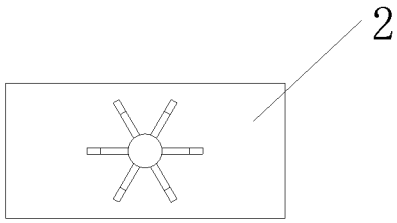
FIG. 12 is a top view of FIG. 11.
Figure 13:
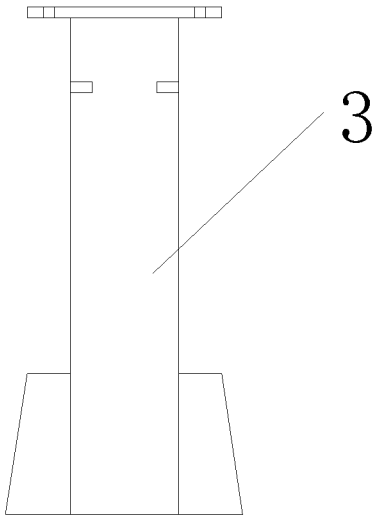
FIG. 13 is a schematic diagram of a lower segment of a pier in FIG. 1.
Figure 14:
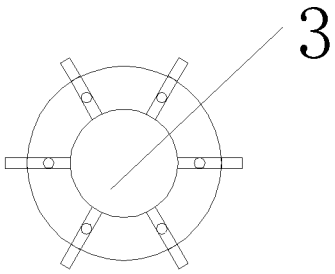
FIG. 14 is a vertical view of FIG. 13.

The drawings non-restrictively disclose a structural schematic diagram of a preferred embodiment involved in the present invention, and the present invention is further illustrated with reference to the drawings and the embodiments FIG. 1 to FIG. 14 show the drawings of a section-assembled type pier column member with a steel-concrete composite structure. Before pouring the pile cap, the pile cap 1 is treated, a pile cap cross section reinforcement tube 2 is pre-embedded and poured, and a groove for placing in a lower segment 3 of the pier is reserved between a top of the pile cap cross section reinforcement tube 2 and a top surface of the pile cap 1, thereby facilitating fabricating an end portion of a hollow steel tube in the lower segment, ensuring the connecting reliability and reinforcing installation and positioning. A stiffening ribbed plate is welded at an end portion of a steel tube pier column in a lower segment to form the lower segment 3 of the pier. When fabricating the lower segment 3 of the pier, the stiffening ribbed plate is arranged at a lower end thereof, a reinforcing mesh clamping sheet 4 is arranged inside an upper end of a tube thereof, a pier connecting ring is arranged outside the lower segment, the lower segment 3 of the pier is embedded in the pile cap 1, concrete connected with the lower segment is poured into the groove, and installation of an upper portion is started after a certain concrete age is reached. A local reinforcing mesh 5 is placed inside an upper portion of the lower segment to install an upper segment 8 of the pier, wherein flange-plate type upper and lower pier connecting rings 7 are arranged outside a lower end of the upper segment 8 of the pier in a prefabricated way, and the upper segment 8 of the pier is connected with the lower segment 3 of the pier via a connecting bolt 6. An upper end of the upper segment is provided with a T-shaped opening outer tube for facilitating lapping I-steel 12 stretched out from the steel cross section. The upper segment 8 of the pier is connected with the steel cross beam 12 longitudinally, and is connected in an assembled way through a transversely connecting bolt 13 and a longitudinally connecting bolt 15 by using bracket angle steel in the meanwhile. The steel cross beam 12 uses an I-shaped cross beam and is provided with a transverse stiffening ribbed plate outside the I-shape in the middle of the two ends, thereby facilitating connecting. The upper segment 8 of the pier is transversely connected with the two ends of the steel cross beam 12, is internally penetrated with transverse pre-stressed steel 9, and is equipped with an anchor 10 at the end portion, tensioning the pre-stressed steel strand in a post-tensioning method. Concrete is poured into the steel cross beam 12 and the steel tube. After a certain concrete age is reached, the upper segment 8 of the pier is transversely connected with the two ends of the steel cross beam 12, tensioning the pre-stressed steel strand in a post-tensioning method. Therefore, the section-assembled type pier column member with a steel-concrete composite structure is formed.

During construction, the size of the pile cap cross section reinforcement tube, the size of the lower segment of the pier, the size of the connecting bolt, the size of the upper segment of the pier, the size of the pre-stressed steel, the size of the steel cross beam, the size of the transverse connecting bolt, the size of the bracket angle steel and the size of the longitudinal connecting bolt are firstly determined according to the design.

The embodiments of the invention are described in details above with reference to the drawings, but the invention is not limited to the described embodiments. Various changes, modification, replacement and transformation made to the embodiments by those having ordinary skills in the art without departing from the scope of the principle and technical ideas of the invention shall still fall within the protection scope of the invention.

The invention claimed is:

1. An assembled type pier column member with a steel-concrete composite structure, comprising a pile cap, a pier column and a cross beam, wherein a reinforcement tube is pre-embedded in the pile cap, the pier column is in a hollow tubular structure and is formed by assembling and connecting an upper segment of a pier and a lower segment of the pier, a bottom end of the lower segment of the pier is installed between the reinforcement tube and concrete, the upper segment of the pier is connected with the cross beam in an assembled way via bracket angle steel; and the cross beam is in a pre-stressed structure.

2. The assembled type pier column member with a steel-concrete composite structure according to claim 1, wherein a bottom of the reinforcement tube is welded with a bottom plate, a stiffening ribbed plate is welded between the bottom plate and a reinforcing plate, and the bottom plate and the stiffening ribbed plate are embedded in the concrete of the pile cap.

3. The assembled type pier column member with a steel-concrete composite structure according to claim 1, wherein a top end of the upper segment of the pier is provided with a T-shaped opening hoop, and a bottom end thereof is provided with a flange plate.

4. The assembled type pier column member with a steel-concrete composite structure according to claim 3, wherein a top end of the lower segment of the pier is provided with a flange plate, and a bottom end thereof is provided with radially-distributed stiffening ribbed plates.

5. The assembled type pier column member with a steel-concrete composite structure according to claim 4, wherein reinforcing meshes are connected between the upper segment of the pier and the lower segment of the pier, and a reinforcing mesh clamping sheet is arranged inside an upper end of the lower segment of the pier.

6. The assembled type pier column member with a steel-concrete composite structure according to claim 5, wherein the cross beam is a steel cross beam with an I-shaped cross section.

7. The assembled type pier column member with a steel-concrete composite structure according to claim 6, wherein concrete is poured into the pier column and the cross beam, and the cross beam is further internally penetrated with a pre-stressed steel strand in a post-tensioning method.

8. A construction method of the assembled type pier column member with a steel-concrete composite structure according to claim 1, comprising the following steps of:

step 1, prefabricating a pile cap, a pier column and a cross beam; arranging a stiffening ribbed plate at a lower end of a lower segment of a pier, arranging a reinforcing mesh clamping sheet inside a tube wall at the upper end, and arranging a pier connecting ring outside the tube wall; arranging a pier connecting ring outside an lower end of an upper segment of the pier, and arranging a T-shaped opening hoop for lapping I-steel stretched out from a steel cross beam at an upper end thereof;

step 2, embedding a pile cap cross section reinforcement tube in the pile cap for ensuring the installation and positioning of the lower segment of the pier and reinforcing stress applied to the segment, then pouring the pile cap;

step 3, sheathing the lower segment of the pier on the pile cap cross section reinforcement tube, and pouring concrete to fixedly connect the lower segment of the pier with the pile cap;

step 4, connecting pier columns in upper and lower segments through a flange plate, and arranging reinforcing meshes inside the cross section for reinforcing connection;

step 5, connecting a hollow steel tube pier column with the steel cross beam, lapping I-steel stretched out from two ends of the steel cross beam in the T-shaped opening hoop arranged at the upper end, and connecting the two in an assembled way through a bolt using bracket angle steel in the meanwhile;

step 6, tensioning a pre-stressed steel strand in a transverse direction of the two ends of the steel cross beam using a post-tensioning method; and step 7, pouring concrete into the steel tube and the cross beam from the steel cross beam.

* * * * *